US006314858B1

(12) United States Patent
Strasser et al.

(10) Patent No.: US 6,314,858 B1
(45) Date of Patent: Nov. 13, 2001

(54) FIBER REINFORCED CERAMIC MATRIX COMPOSITE ARMOR

(75) Inventors: Thomas Edward Strasser, Corona; Steven Donald Atmur, Riverside, both of CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/354,246

(22) Filed: Jul. 15, 1999

Related U.S. Application Data

(62) Division of application No. 08/854,293, filed on May 12, 1997, now Pat. No. 5,970,843.

(51) Int. Cl.[7] ..... F41H 1/00; F41H 5/04

(52) U.S. Cl. ..... 89/36.02; 264/640; 89/36.08; 89/36.05; 2/2.5

(58) Field of Search ..... 89/36.02, 36.08, 89/36.05; 264/640, 641, 645, 328.2, 328.18; 2/2.5

(56) References Cited

U.S. PATENT DOCUMENTS

| | | | | |
|---|---|---|---|---|
| H1061 | | 6/1992 | Rozner et al. | 89/36.02 |
| 3,395,067 | | 7/1968 | Lane, Jr. | 161/119 |
| 3,705,558 | | 12/1972 | McDougal et al. | 109/84 |
| 3,722,355 | | 3/1973 | King | 89/36 |
| 3,813,281 | | 5/1974 | Burgess et al. | 161/159 |
| 4,837,230 | * | 6/1989 | Chen et al. | 428/262 |
| 5,023,041 | * | 6/1991 | Jones et al. | 264/328.4 |
| 5,352,529 | | 10/1994 | Scanlon et al. | 428/428 |
| 5,411,763 | * | 5/1995 | Weaver et al. | 427/249 |
| 5,738,818 | * | 4/1998 | Atmur et al. | 264/640 |

FOREIGN PATENT DOCUMENTS

| | | | | |
|---|---|---|---|---|
| 74170 | | 12/1944 | (CS) | 89/36.02 |
| 0376794 | | 7/1990 | (EP) | 89/36.02 |
| 1260111 | | 1/1972 | (GB) | 89/36.02 |
| 2277141 | * | 10/1994 | (GB) | 89/36.02 |

* cited by examiner

*Primary Examiner*—Stephen M. Johnson
(74) *Attorney, Agent, or Firm*—Terry J. Anderson; Karl J. Hoch, Jr.

(57) ABSTRACT

An integrated, layered armor structure having multiple layers which alternate in their exhibited characteristics between extremely hard and ductile. The extremely hard layers of the armor structure are designed to shatter an impacting projectile, or pieces thereof, and to fracture in such a way as to dissipate at least a portion of the kinetic energy associated with the projectile pieces and to disperse the projectile pieces and hard layer fragments over a wide area. The ductile layers of the armor structure are designed to yield under the force of impinging projectile pieces and hard layer fragments from an adjacent hard layer. This yielding dissipates at least a portion of the remaining kinetic energy of these pieces and fragments. Pieces and fragments not possessing sufficient kinetic energy to tear through the ductile layer are trapped therein and so stopped.

12 Claims, 3 Drawing Sheets

FIBER REINFORCED CERAMIC MATRIX COMPOSITE ARMOR

This is a divisional application of parent patent application Ser. No. 08/854,293, filed May 12, 1997 now U.S. Pat. No. 5,970,843 which issued Oct. 26, 1999.

BACKGROUND

1. Technical Field

This invention relates to armor for structures, machines and personnel, and more particularly, to an integrated, layered armor incorporating fiber reinforced ceramic matrix composite (FRCMC) material layers and methods for making it.

2. Background Art

Certain types of armor for protecting various structures and machines, as well as body armor for the protection of human beings, has been constructed from monolithic ceramic materials. These materials offer advantages in that they can be extremely hard and light weight. The extreme hardness of ceramic armor has advantages in that incoming projectiles can be shattered on impact. For example, armor made of monolithic ceramic materials is used on tanks to protect against high energy ignition (HEI) rounds. These types of projectiles are designed to penetrate into the interior of the tank before exploding. The monolithic ceramic armor is used to detonate these rounds on impact before they can penetrate the skin of the tank. This ability to detonate the HEI rounds derives from the extreme hardness exhibited by ceramic armor.

Typically, ceramic armor is made up of numerous, flat monolithic ceramic plates or tiles. These plates are sometimes arranged end to end and attached to the surface which is to be protected, such as for example, on the bottom of an airplane or helicopter to protect these aircraft from ground fire. The ceramic plates are also sometimes incorporated into a garment, such as a so called "bullet proof" vest, or other body armor.

Although, armor constructed of monolithic ceramic plates has advantages as described above, it tends to be brittle. Typically, the impact of just one round (i.e. projectile) will shatter an entire plate of the monolithic ceramic armor, even those un-impacted areas of the plate adjacent the impact site. Thus, the entire plate is rendered ineffective against subsequent rounds. In addition, the nature of monolithic ceramic materials and their associated forming methods precludes forming complex shapes or large pieces. Essentially, ceramic armor must be constructed from the aforementioned flat ceramic plates. In the case where ceramic armor is employed on an aircraft, ground vehicle, etc., there can be installation problems associated with attaching numerous flat ceramic plates to a surface that may be curved. In addition, having these numerous small plates attached to an aircraft can increase the aerodynamic drag. Additionally, constructing body armor from flat monolithic ceramic armor plates results in a cumbersome unit which tends to restrict the wearer's movements.

Accordingly, there is a need for armor which exhibits the extreme hardness of monolithic ceramic armor, but which is less brittle, capable of withstanding multiple projectile impacts, and can be formed in large, conformal shapes.

Wherefore, it is an object of the present invention to provide armor which exhibits a degree of hardness which causes projectiles to shatter upon impact, but at the same time exhibits an overall increased ductility so as to facilitate stopping the resulting pieces of the projectile from passing completely through the armor and prevents the shattering of adjacent un-impacted portions of the armor.

Wherefore, it is another object of the present invention to provide armor which can be formed into practically any shape and size desired, so as to be made to conform to the shape of the structure, machine, or even person it is meant to protect.

SUMMARY

The above-described objectives are realized with embodiments of the present invention directed to an integrated, layered armor structure having multiple layers which alternate in their exhibited characteristics between extremely hard and ductile. The extremely hard layers of the armor structure are designed to shatter an impacting projectile, or pieces thereof, and to fracture in such a way as to dissipate at least a portion of the kinetic energy associated with the projectile pieces, and to disperse the projectile pieces and hard layer fragments (and so their kinetic energy) over a wide area. The ductile layers of the armor structure are designed to yield under the force of impinging projectile pieces and hard layer fragments. This yielding dissipates at least a portion of the remaining kinetic energy of these pieces and fragments. Pieces and fragments not possessing sufficient kinetic energy to tear through the ductile layer become trapped therein, and so are stopped. Preferably, there is at least one hard layer and one ductile layer, although there can be additional layers as well, alternating between hard and ductile. The innermost layer which forms the back side of the armor can be either a hard or ductile layer. Likewise, the outermost layer of the armor can be either a hard or ductile layer depending on the application. For example, in some armor applications, particularly where the threat of multiple impacts is high, it is desirable that the outermost layer be a ductile one to increase the retention of fragmented hard layer material shattered by a previous impact. Without the overlying ductile layer, the fractured pieces of the hard layer would simply fall to the ground. However, if retained by the overlying ductile layer, these fragmented pieces of the hard layer will provide some protection, albeit to a lesser degree than a "virgin" layer, against subsequent projectile impacts in the same general area.

Preferably, the degree of hardness of each hard layer is maximized to ensure a substantial shattering of an impacting projectile. In addition, the ductility of each ductile layer is preferably maximized so as to ensure as much of the kinetic energy of the projectile pieces and hard layer fragments as possible is dissipated. It is also noted that each layer is responsible for dissipating some portion of the kinetic energy associated with the impacting projectile, and that the thickness of a layer determines at least in part how much energy is dissipated. The greater the thickness, the greater a layer's kinetic energy-dissipating ability. Given this, it is also preferred that the number of layers and thickness for each layer be selected so as to ensure any impacting projectile is stopped. Further, because the number of layers and their thicknesses will determine the weight of the armor and its overall thickness, and because this weight and overall thickness must be minimized in many applications (e.g. aircraft, body armor), it is preferred that the aforementioned selection be made so as to minimize the number of layers and the thickness of each layer to just that which will ensure the armor is capable of stopping the impacting projectile. In this regard, it is noted that the kinetic energy associated with the projectile pieces will be progressively lower for each hard layer employed in the armor. Accordingly, the thicknesses of these layers can also be progressively reduced to reduce the weight and overall thickness of the armor.

In some cases, it may be advantageous to forego a certain amount of hardness in a hard layer in deference to a higher ductility. This variation would be useful, for example, where the weight and overall thickness of the armor must be limited to a point where certain potentially encounterable projectiles could not be completely stopped from passing through the armor. In such a case, a modified hard layer having a lower hardness would not tend to shatter an impacting projectile, or piece thereof, to the same extent, but the increased ductility would increase the layer's kinetic energy-dissipating ability, thereby increasing the range of projectiles that can be stopped by the armor. Incorporating such a modified hard layer as the innermost layer of the armor would be one example where this feature would be advantageous. In such a case, the projectile would have already been substantially broken into pieces by the preceding hard layers, thereby dispersing the energy over a wider area. Thus, further shattering of the projectile pieces may not be as effective in stopping them, as would increasing the ability of the layer to dissipate the remaining kinetic energy (without increasing its thickness or adding weight to the armor).

In one embodiment of the integrated, layered armor constructed in accordance with the present invention, the layers are formed of fiber reinforced ceramic matrix composite (FRCMC) materials. FRCMC materials generally comprise a mixture of pre-ceramic polymer resin converted to its ceramic form, fibers, and in some cases filler materials. The hard and ductile layers can differ in the type, form, and percentage of fibers. In addition, the hard layers include hardness-producing filler materials. However, the layers are integrated with one another via a common ceramic matrix. The type and form of fibers employed in the ductile layers is designed to impart the required ductility to the layer. For example, it is preferred that the fibers used in the ductile layer take the form of one or more tightly woven fiber sheets characterized by a continuous fiber configuration. This form of fiber will produce a high degree of ductility. In addition, the percent by volume of the ductile layer comprising the woven fibers is made large enough to produce the desired high degree of ductility. In comparison, the hard layers incorporate sufficient quantities of hardness-producing filler materials so as to produce the desired degree of hardness in the hard layer. In the case of the previously-described hard layer with a lesser degree of hardness, but increased ductility, this could be accomplished by reducing the percent by volume of filler material in the layer, and replacing it with additional fibers.

The layered FRCMC armor structure is preferably formed via a compression molding process, although any applicable FRCMC molding process which can produce the above-described integrated layered structure would also be acceptable (e.g. autoclave curing, resin transfer molding, etc.). The preferred compression molding method generally includes a first step of placing a quantity of FRCMC bulk molding compound into a female die of a mold. The FRCMC bulk molding compound is used to form an external hard layer of the armor and is made of a pre-ceramic resin, fibers and the aforementioned hardness-producing filler materials. At least one sheet of woven fibers is then placed on top of the layer of bulk molding compound to form a ductile layer of the armor. The first two steps are repeated as desired to form subsequent hard and ductile layers of the armor. Alternately, if the external layer of the armor is to be a ductile layer, the above-described steps are reversed. Once all the desired layers are in place, a male die is pressed onto the female die so as to mold the armor in a cavity formed between the female and male dies. The shape of the armor will be dictated by the shape of the mold cavity. This allows the armor to be formed into practically any shape and size desired, so as to be made to conform to the shape of the structure, machine, or even person it is meant to protect. The mold is next heated at a temperature and for a time consistent with polymerizing the pre-ceramic resin to form a fiber-reinforced polymer composite structure. The polymerized composite structure is removed from the mold and heated again at a temperature and for a time consistent with pyrolyzing the polymerized resin, thus forming the ceramic matrix which integrates the various hard and ductile layers.

The integrated, layered armor can also include a backing structure disposed adjacent the exterior facing surface of at least the backside of the FRCMC layers (although it could encase all or a substantial portion of the FRCMC structure if desired). This backing structure is used to support the FRCMC layers and interface the armor with the article or machine being armored. For example, the backing structure might take the form of a door frame for a door of an armored personnel carrier. The backing structure would include all the interfacing parts necessary to attach the door to the vehicle. The backing structure also provides some additional projectile stopping capability to the armor. Preferably, the backing structure is made of a fiber reinforced organic composite material which is formed onto the already completed FRCMC structure via any appropriate conventional method, such as compression molding.

In another embodiment of the integrated, layered armor constructed in accordance with the present invention, layers of the aforementioned fiber reinforced organic composite materials are integrated within the armor structure. These organic composite layers could replace one or more of the ductile FRCMC layers in the armor structure, or could be integrated between one or more pairs of hard and ductile FRCMC layers within the armor structure. Essentially, the organic composite layers would function in much the same way as the ductile FRCMC layers described previously.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

FIGS. 2A–D are cross-sectional, exploded views of a hard layer and an adjacent ductile layer of the integrated, layered FRCMC armor of FIG. 1, wherein FIG. 2A depicts the instance when a projectile impacts the hard layer and shatters, FIG. 2B depicts a subsequent time when the hard layer has fractured and pieces of the shattered projectile and fragments of the hard layer impinge on the ductile layer, and FIG. 2C depicts a time when some of the pieces and fragments have become embedded in the ductile layer while others have torn through the layer.

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

A first embodiment of a layered armor structure constructed in accordance with the present invention employs integrated fiber-reinforced ceramic matrix composite (FRCMC) layers which alternate in their exhibited characteristics. Specifically, the exhibited characteristics alternate between extremely hard (e.g. greater than 2700 knoop) and ductile (e.g. greater than 0.5 percent strain at failure).

FRCMC materials in general are made by combining a pre-ceramic polymer resin, such as silicon-carboxyl resin sold by Allied Signal under the trademark BLACKGLAS™ or alumina silicate resin (commercially available through Applied Poleramics under the product description CO2), with some type of fibers. In addition, the material can include filler materials preferably in the form of powders having particle sizes somewhere between about 1 and 100 microns. The resin, fiber, and possibly filler material mixture is formed into the shape of the desired structure via one of a variety of methods and heated for a time to a temperature, as specified by the material suppliers (typically between 1,500° F. and 2,000° F.), which causes the resin to be converted into a ceramic. The layered FRCMC armor according to the present invention is referred to as having an integrated FRCMC structure because its layers, although potentially having differing types and forms of fibers, and some having filler materials, are joined by a common ceramic matrix. The ceramic matrix is present throughout the overall structure extending from one layer to the next, thus binding the layers together and integrating the structure.

The fibers, no matter what type and form employed, are preferably first coated with an interface material such as carbon, silicon nitride, silicon carbide, silicon carboxide, boron nitride or multiple layers of one or more of these interfacial materials. The interface material prevents the resin from adhering directly to the fibers of the fiber system. Thus, after the resin has been converted to a ceramic, there is a weak interface between the ceramic matrix and the fibers. This weak bond enhances the overall strength exhibited by the FRCMC material.

Figure 1:
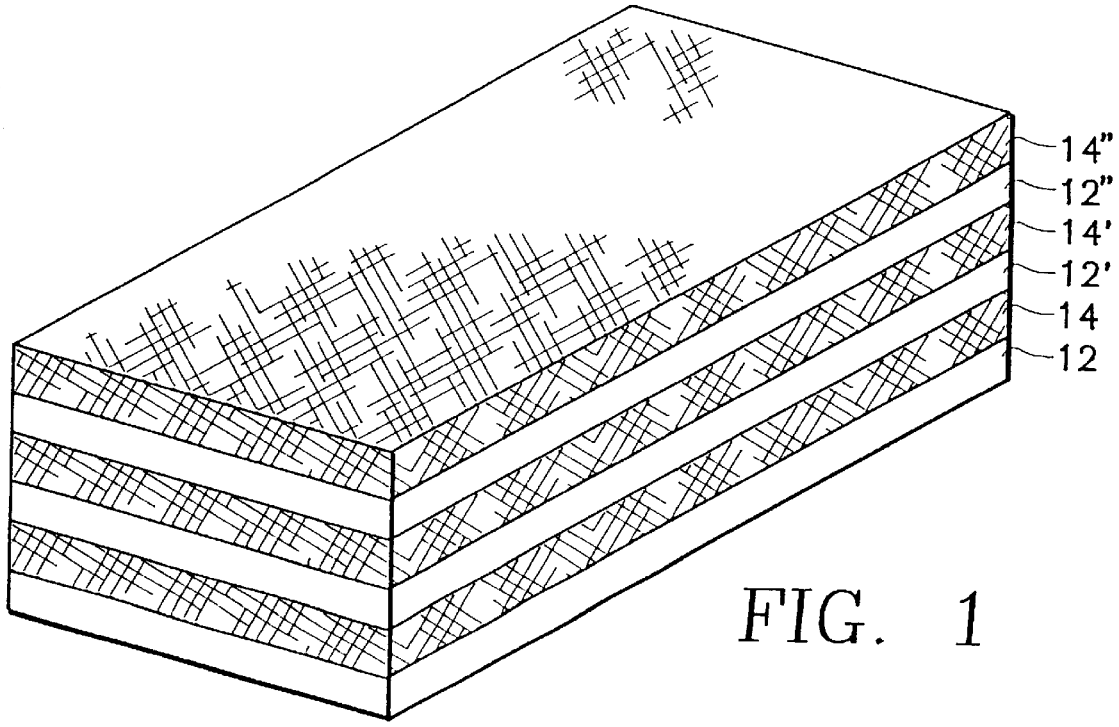
FIG. 1 is a perspective view of a integrated, layered FRCMC armor structure in accordance with the present invention.

An example of the structure of layered FRCMC armor in accordance with the present invention is depicted in FIG. 1. In this example, the structure includes six layers with the first layer 12 being hard, the second layer 14 being ductile, and the remaining four layers 12', 14', 12", 14" alternating between hard and ductile. The hard layers 12, 12', 12" are given this hardness by the addition of a ceramic filler material. The filler material can amount to 25–60 percent of the overall FRCMC material in the hard layers 12, 12', 12", and are preferably one or more of the following materials: alumina, silicon carbide, silicon nitride, tungsten carbide, chrome carbide, chrome oxide, mullite, silica, boron carbide, and the like. The ductile layers 14, 14', 14" are given their ductility by the fibers employed therein. Specifically, the types of fibers which might be employed include alumina, Altex, Nextel 312, Nextel 440, Nextel 510, Nextel 550, silicon nitride, silicon carbide, HPZ,¯graphite, carbon, or peat. These fibers will preferably take the form of tightly woven fiber sheets, as this form of fiber gives the ductile layer 14, 14', 14" the greatest amount of isotropic ductility per unit of fiber volume used. Additionally, the ductility of a FRCMC layer increases with increasing amounts of fibers (up to a fiber volume limit determined by the type of fiber and weave pattern employed). The ductile layers 14, 14', 14" of the armor according to the present invention should contain between about 30 and 60 percent by volume of fibers having the aforementioned woven or braided form, but preferably should contain in excess of 40 percent to ensure maximum ductility.

Figure 2A:
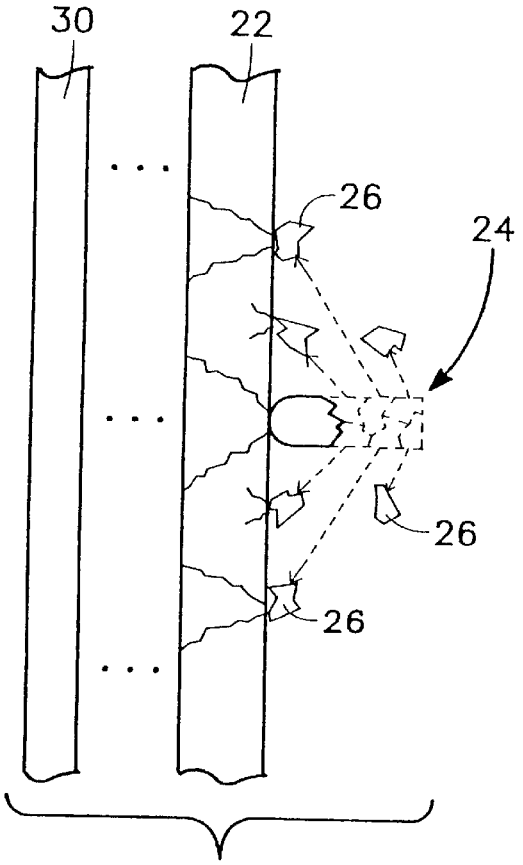
Figure 2B:
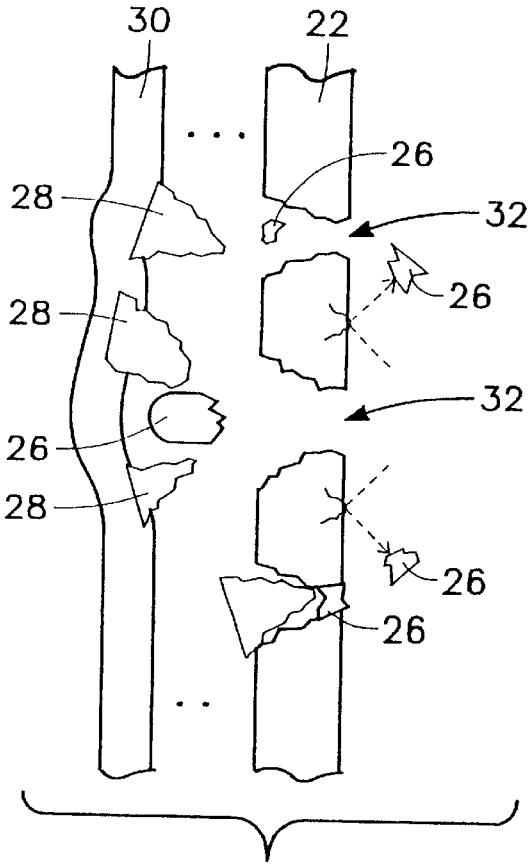
Figure 2C:
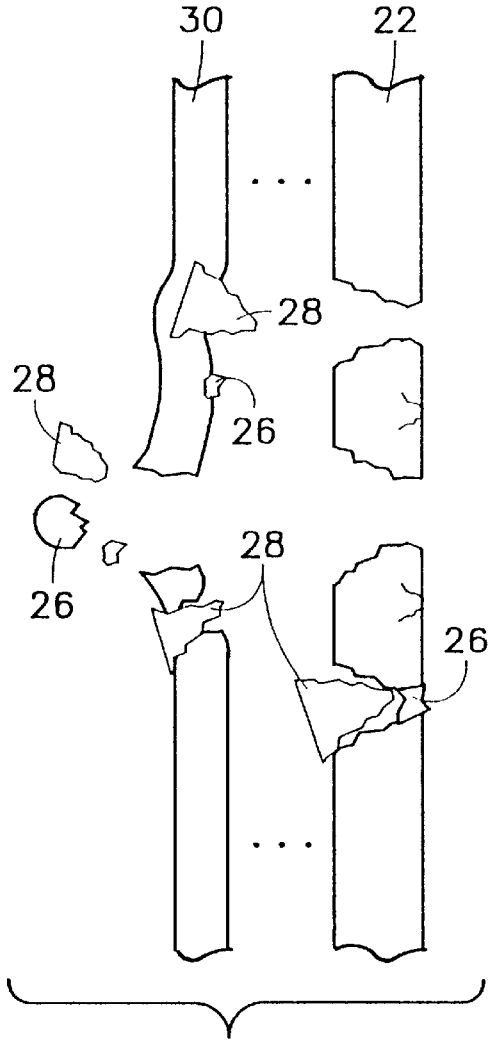

Referring now to FIGS. 2A–C, it will be explained how the layered FRCMC armor functions. It is noted that these figures are meant to aid in the understanding of the functionality of the armor. To this end the depictions are simplified and idealized, and show only two of potentially many alternating hard and ductile layers. As shown in FIG. 2A, the hard layer 22 is designed to fracture upon impact with a projectile 24 so as to dissipate some of the projectile's kinetic energy, while at the same time breaking the projectile 24 up into smaller pieces 26. These pieces 26 also impact the front face of the hard layer 22, and cause further fracturing and absorption of energy. The pieces 26 of the shattered projectile also impact the front face of the hard layer 22 over a wider area than would be the case had the projectile 24 remained intact. This has the further effect of dispersing the kinetic energy over a large area of the hard layer 22, thus facilitating its dissipation via local fracturing in the vicinity of the impact of the pieces 26.

In some instances a piece 26 of the projectile will not have sufficient kinetic energy to fracture or at least completely fracture the hard layer at its impact point, and will deflect off of the hard layer. In other words, all of the energy of the piece 26 is dissipated by the hard layer 22, and no penetration occurs (i.e. a key objective of the invention). However, in other cases, a piece 26 of the projectile impacting the front face of the hard layer 22 will strike with enough energy to completely fracture and penetrate the hard layer in the area adjacent the impact point. Further, the energy dissipated by the hard layer at this location may exceed that required to completely fracture it, thereby transferring momentum to the resulting fragments 28 of the hard layer, and causing the fragments 28 to be projected toward the ductile layer 30. FIG. 28 illustrates both cases, i.e. situations where the projectile pieces 26 do not break through the hard layer 22, as well as situations where of projectile pieces 26 which do completely fracture the hard layer 22 and pass through into the ductile layer 30. Where the hard layer 22 is completely fractured, FIG. 28 also illustrates the fragments 28, being projected into the ductile layer 30. As can be seen, the hard layer 22 tends to fracture in a characteristic pattern. This pattern is analogous to the example of a BB hitting a glass window. The hard layer 22 fractures in a cone shape pattern leaving a hole 32 in the hard layer characterized by a small opening at the point of impact. This small opening expands in a conical shape and terminates at the other side of the hard layer 22 in an opening having many times the surface area of the small impact opening. The fragments 28 may initially have a cone shape corresponding to the shape of the hole 32. However, it is likely the fragments 28 will breakup further as they are projected into the ductile layer 30 being that the ductile layer is still typically harder than the projectile.

The ductile layer 30 is designed to further dissipate the kinetic energy associated with the pieces 26 of the projectile and fragments 28 from the hard layer which are projected into it. The above-described fracturing of the hard layer 22 results in an advantageous dispersing of the original kinetic energy of the projectile 24 as the fragments 28 and pieces 26 will impact the ductile layer 30 over an increasing area. The kinetic energy transferred to the fragments 28 which caused them to be projected into the ductile layer 30 is spread out over a wider surface area owing to the conical shape of the fracturing pattern. In addition, the pieces 26 of the projectile which make it through the hard layer 22 will be spread out over a much larger area and possess less kinetic energy, in comparison to an intact projectile. This spreading out of the impact sites of the pieces 26 and fragments 28 on the ductile layer 30 effectively disperses the kinetic energy and so facilitates its dissipation by the ductile layer. The ductile layer 30 dissipates the energy by yielding in the locality of the impact site of the incoming projectile pieces 26 and hard layer fragments 28. Since the pieces 26 and fragments 28 are spread out and contain only fractional portions of the original kinetic energy of the projectile 24, the yielding of the ductile layer 30 in the immediate vicinity of the impact sites will result in more of the overall energy being dissipated.

As depicted in FIG. 2C, the ductile layer 30 will dissipate all of the kinetic energy of some of the impacting pieces 26 and fragments 28. These pieces 26 and fragments 28 become imbedded in the ductile layer 30 and so are stopped. However, other pieces 26 and fragments 28 may possess enough kinetic energy to eventually tear through the ductile layer 30 and escape, albeit with less remaining energy.

Figure 2D:
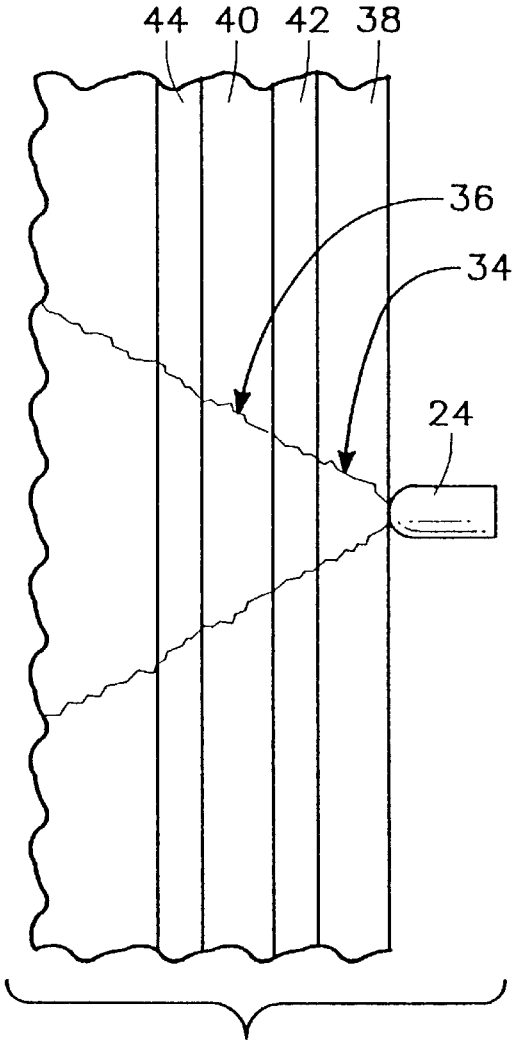

Preferably, there are sufficient successive hard and ductile layers to dissipate the remaining kinetic energy of these pieces and fragments, so as to stop them as well. This is accomplished in the same manner as described above, i.e. a succeeding hard layer will act to further break up the projectile pieces and to dissipate and disperse the kinetic energy thereof by the aforementioned fracturing process, and a succeeding ductile layer will dissipate the kinetic energy by yielding. It is noted that the dispersement of the kinetic energy is an important aspect of the multi-layer armor according to the present invention. Referring to FIG. 2D, it can be seen that the conical fracture patterns 34, 36 in successive hard layers 38, 40 has the effect of spreading the impacting pieces and fragments, and so the total remaining kinetic energy associated therewith, over an increasingly larger area. As discussed previously, this assists in the dissipation of this energy by the successive hard 38, 40 and ductile layers 42, 44.

An additional advantage of the composite armor according to the present invention is that the integrated multi-layer structure stops the propagation of fractures within the hard layers of the armor. As discussed previously, monolithic ceramic armor plates tended to completely shatter upon impact by a projectile. However, the integrated structure of layered FRCMC armor acts to localize the shattering of the hard layer in vicinity of the impact site. The fracture does not propagate throughout the entire hard layer, as it does in a monolithic ceramic armor plate. Further, it is noted that the ductile layers tend to hold most of the fractured pieces of an adjacent hard layer within the area of impact. This has the advantage of giving the now fractured portion of the hard layer the ability to provide some protection, albeit to a lesser degree than a "virgin" layer, against subsequent projectile impacts in the same general area. This protective effect results from the fragments of the hard layer acting to breakup the projectile and dissipating some of the kinetic energy associated therewith. Given the protective effect of the fractured pieces of a hard layer, it is noted that in some armor applications, particularly where the threat of multiple impacts is high, it is desirable that the outermost layer be a ductile one to increase the retention of fragmented hard layer material shattered by a previous impact. Without the overlying ductile layer, the fractured pieces of the hard layer would simply fall to the ground. However, if retained by the overlying ductile layer, these fragmented pieces of the hard layer would be retained and provide some limited ability to stop an impacting projectile.

The layered FRCMC armor according to the present invention can be formed from the previously-described materials by a variety of methods generally applicable to polymer composite part formation. These methods can include resin transfer molding (RTM), compression molding, or injection molding. However, it is not intended to limit the invention to any particular method. Rather any appropriate method may be employed to form the FRCMC armor.

An advantage of the aforementioned forming methods is that a wide variety of shapes can be given to the layered FRCMC armor structure. As discussed previously, existing monolithic ceramic armor takes the form of small, flat plates. The nature of the monolithic ceramic materials and their associated forming methods precludes forming complex shapes or large pieces. However, these constraints do not apply to the layered FRCMC armor structure according to the present invention. This armor can be formed into practically any shape and size desired, so as to be made to conform to the shape of the structure, machine, or even person it is meant to protect. For example, the so-called "bullet-proof" vest or other body armor made from monolithic ceramic armor panels is bulky and cumbersome, and can have gaps between panels leaving the wearer vulnerable in those areas. Whereas, layered FRCMC armor according to the present invention can be shaped to conform the body of the wearer, thereby providing a more comfortable fit, without any potentially dangerous gaps. Another example of the advantages of conformal FRCMC armor is in the protection of the underside of a helicopter from small arms ground fire. Currently armoring systems for this application often employ a large number of individual monolithic ceramic tiles installed edge to edge across the bottom of the helicopter. However, the layered FRCMC armor can be formed into a single, large structure which conforms to the bottom of the helicopter. Such an armor system would reduce aerodynamic drag and make installation much easier.

Figure 3:
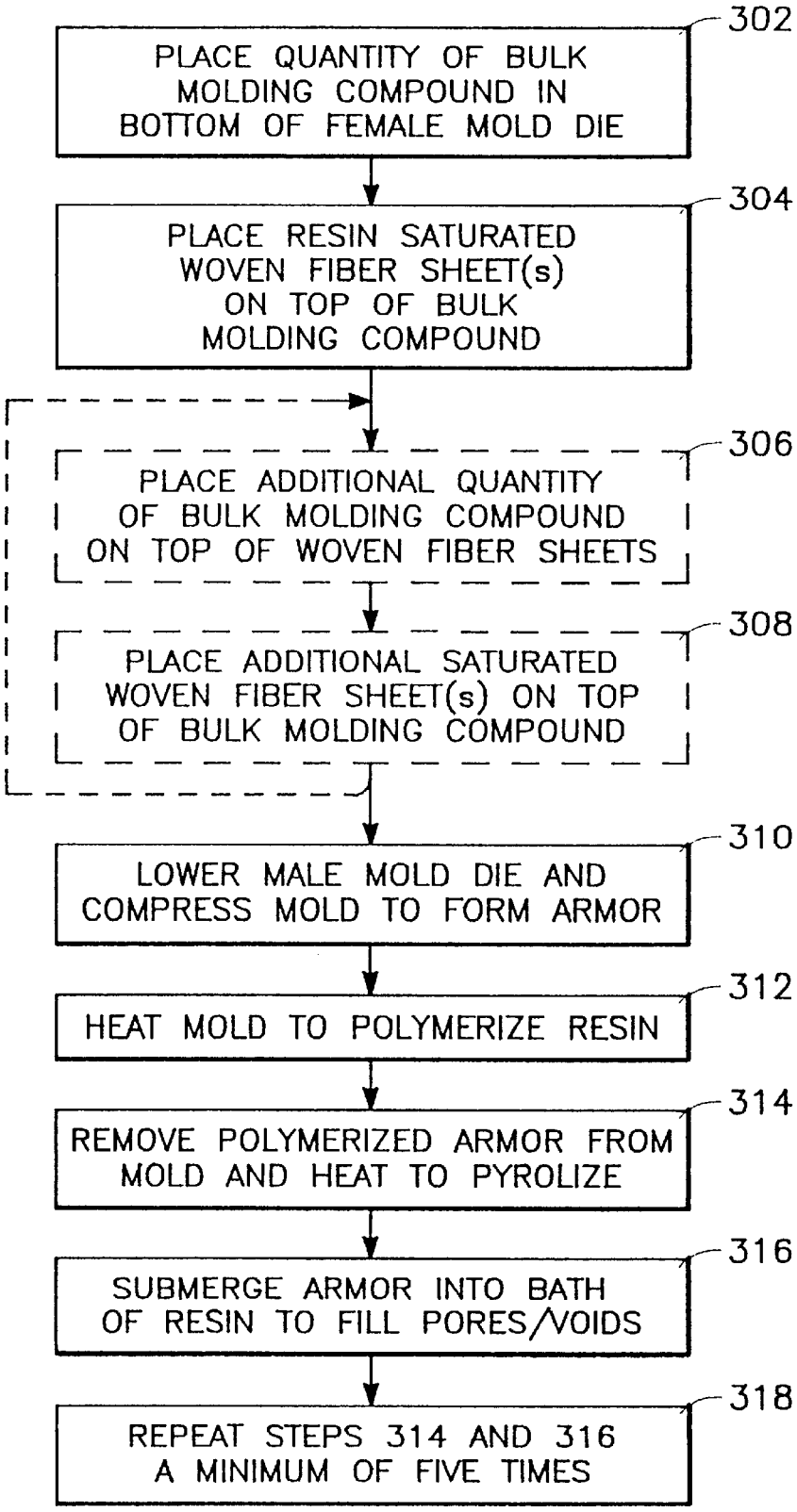
FIG. 3 is a block diagram of a method for the compression molding of the integrated, layered FRCMC armor of FIG. 1.

The preferred method of forming a layered FRCMC armor structure according to the present invention is via a compression molding process as described in a co-pending application entitled COMPRESSION/INJECTION MOLDiNG OF POLYMER-DERIVED FIBER REINFORCED CERAMIC MATRIX COMPOSITE MATERIALS having the same inventors as the present application and assigned to a common assignee. This co-pending application was filed on Aug. 28, 1996 and assigned Ser. No. 08/704,348. The disclosure of this co-pending application is herein incorporated by reference. The following simplified process, summarized in FIG. 3, provides an example of using the aforementioned compression molding process to form a layered FRCMC armor structure having a hard layer hardness of approximately 2900 knoop, and a ductile layer with an ultimate strain at failure of approximately 0.6 percent.

1. A quantity of pre-mixed bulk molding compound is placed in the bottom of a female mold die (step 302). This female mold die has a shape which in combination with a male mold die forms a cavity there between having the desired shape of the armor structure being formed. The bulk molding compound will ultimately form an external hard layer of the armor structure, and should be of a sufficient quantity to form a layer having the desired thickness. The desired thickness of the armor layers will be discussed in greater detail later in this disclosure. It should be noted, however, that although this example forms an external hard layer first, this need not be the case. The layer of the armor designed to take the initial impact of a projectile is preferably a hard layer because of the advantageous shattering of the projectile when it contacts a hard layer. If the bottom of the female die of the mold corresponds to this first-impact face, then it is preferably a hard layer. However, if the bottom of the female mold corresponds to the backside of the armor structure, it could be either a hard or ductile layer. If the initial layer is to be a ductile one, it should be formed as will be described below. The pre-mixed bulk molding compound is made up of the amount of chopped fiber which once distributed and packed in the mold will produce the desired percent volume of fiber in the aforementioned exterior hard layer of the armor structure. In this case, Nextel 312 fibers constituting approximately 30 percent by volume of the layer and having lengths of about 0.5 inches were chosen. In addition, the molding compound includes the amount of alumina filler material which once distributed and packed in the mold will constitute approximately 50 percent by volume of the layer. This will produce the desired hardness. Finally, the molding compound of this example has the amount of BLACKGLAS™ resin which at a reasonable viscosity (e.g. about 5,000 to 10,000 centipoises) will facilitate the flow of fibers and filler material, while still allowing it to pass around packed fibers and filler material and out of the resin outlet ports of the compression mold, as described in the aforementioned co-pending application. Additionally, prior to mixing into the bulk molding compound, it is preferred that the fibers be coated with the aforementioned interface material(s). In this case, one 0.1 to 0.5 micron thick layer of boron nitride was chosen as the interface material.

2. Next, the woven fiber sheet or sheets which will ultimately form a ductile layer of the armor is placed on top of the initial layer of bulk molding compound (step 304). In this case, two plies of a woven Nextel 312 fiber cloth saturated with BLACKGLAS™ resin having a low viscosity (i.e. less than 10 centipoises) were used. Each sheet of fiber cloth is shaped so as to completely cover the entire horizontal cross-sectional area of the female mold at the location of the ductile layer being formed. The number of plies used in the ductile layer is tied to the thickness of the layer and will be more fully discussed later.

3. The hard layer-forming step is then repeated if more layers are to be added to the armor structure by placing additional quantities of bulk molding compound on top of the woven sheet(s) of ceramic fiber cloth (optional step 306 shown in dashed lines). Similarly, the ductile layer-forming step can be repeated after each hard layer forming step as desired to incorporate additional ductile layers (optional step 308 shown in dashed lines). As discussed above, if the last layer to be formed is intended to take the initial impact of a projectile, then it is preferably a hard layer. However, if the last layer formed is to be the backside of the armor structure, it can be either a hard layer of ductile layer. In this example, four more layers were incorporated starting with a hard layer, and then alternating between ductile and hard layers, ending in a ductile layer which was intended as the back surface of the armor structure. It is noted that in the example, the same types of fibers and filler material (if any) where employed for each like layer. However, if desired, the types of fibers and filler materials, and their percentages, could be varied to tailor the exhibited characteristics of each layer.

4. Next, the male die is lowered and the mold compressed to form the armor structure (step 310). As the layers of bulk molding compound are compressed, excess resin present in the bulk molding compound associated with the hard layers can flow into the sheets of ceramic fiber cloth. Any additional excess resin is ejected from the mold through the resin outlet ports. If the ceramic cloth has a tightweave structure (i.e. relatively dense), as it preferably would to maximize strength), then the fibers and filler materials present in the bulk molding compound in an adjacent hard layer will not readily flow into the cloth. Thus, the fibers and filler materials associated with the hard layers will remain in those layers and not effect the characteristics of the ductile layers. It is also noted that although the resin will flow into a dense fiber cloth, the path of least resistance to the resin flow may be through the outlet ports. Accordingly, it is preferred that the ceramic cloth be pre-saturated with BLACKGLAS™ resin prior to being placed in the mold to ensure there are no voids in the finished part which could weaken its structure (see step 304).

5. The molded armor structure is then heated within the mold to polymerize the resin (step 312). The following cycle (as recommended by the manufacturer of the BLACKGLAS™ resin) is preferred:

A) Ramp from ambient to 150° F. at 2.7°/minute

B) Hold at 150° F. for 30 minutes

C) Ramp at 1.7°/minute to 300° F.

D) Hold at 300° F. for 60 minutes

E) Cool at 1.2°/minute until temperature is below 140° F.

It should be noted that there are a variety of heat-up cycles which will create usable hardware and the foregoing is by way of one example only and not intended to be exclusive. The armor structure is now in a "green state" similar to bisque-ware in ceramics, such that it does not have its full strength as yet, but can be handled.

6. The now polymerized armor structure is removed from the mold and pyrolized in an controlled inert gas environment as suggested by the resin manufacturer (step 314). This pyrolization process preferably involves firing the armor structure per the following schedule (as recommended by the resin manufacturer):

A) Ramp to 300° F. at 223°/hour

B) Ramp to 900° F. at 43°/hour

C) Ramp to 1400° F. at 20°/hour

D) Ramp to 1600° F. at 50°/hour

E) Hold at 1600° F. for 4 hours

F) Ramp to 77° F. at −125°/hour

Again, there are a variety of heating schedules other than this one, which is given by way of example only, that will yield usable hardware.

7. Upon cooling, the armor structure is preferably removed from the furnace and submerged in a bath of BLACKGLAS™ resin for enough time to allow all air to be removed from the component, typically 5 to 60 minutes (step 316). A vacuum infiltration may also be used. This step fills any outgassed pores formed in the armor structure during the pyrolization process.

8. The preceding two heating and submerging steps are then repeated until the remaining outgassed pores are below a desired level (e.g. less than 10 percent by volume). Typically, this cycle will be repeated five times to obtain the desired porosity level (step 318). The layered FRCMC armor structure is then ready for use.

The ability of the layered FRCMC armor to stop a projectile (such as those in the 7.63 millimeter APM2 class)

from passing through the armor structure, or at least dissipating enough of the kinetic energy associated with the pieces of the projectile so as to minimize any damage these pieces might do if they do pass through the armor, depends on several factors. These factors include the number of alternating hard and ductile layers incorporated into the structure of the armor, the thickness of each layer, the degree of hardness associated with the hard layers, and the degree of ductility associated with the ductile layers. In regards to the degree of hardness and ductility exhibited by the hard and ductile layers, respectively, it is preferable that these characteristics be maximized. Maximizing the hardness and ductility allows the number and thickness of the layers to be minimized, thereby reducing the cost, weight, and overall thickness of the armor. Maximizing the hardness of a hard layer accomplishes the aforementioned goals because a harder layer will result in the creation of more and smaller pieces of the projectile, and potentially a wider distribution of these pieces. As a result, the ductile layer will be more efficient at dissipating the kinetic energy associated with the projectile pieces. As for maximizing the ductility of the ductile layer, this has the effect of maximizing its energy-dissipating ability. Since the kinetic energy dissipating capabilities of the armor are increased by maximizing the hardness and ductility of the respective hard and ductile layers, fewer, and thinner layers can be employed in stopping a projectile. This results in a lower weight for the armor, which depending on the application can be a critical concern. For example, if the armor is intended to be used in a "bullet proof" vest, it should be as light as possible so as to minimize any discomfort of the wearer and to have as little effect on the wearer's mobility as possible. Another example of an application where weight is of primary concern would be for armor employed on aircraft, or motorized vehicles. Maximizing the hardness of a FRCMC material for use in the hard layer involves the selection of a type of filler material which will increase the hardness of the material, as well as employing as much of it as is practical. Maximizing the ductility of an FRCMC material for use in the ductile layer involves the selection of the appropriate type and form of fiber, as well as employing as much of it as possible. The selection process for tailoring the hardness and ductility of a FRCMC material is the subject of a co-pending application entitled REINFORCED CERAMIC MATRIX COMPOSITE MARINE ENGINE RISER ELBOW POLYMER-DERIVED FIBER REINFORCED CERAMIC MATRIX COMPOSITE MATERIALS HAVING TAILORED DUCTILITY, HARDNESS AND COEFFICIENT OF FRICTION CHARACTERISTICS having the same inventors as the present application and assigned to a common assignee. This co-pending application was filed on Feb. 21, 1997 and assigned Ser. No. 08/804,451. The selection process disclosed in the co-pending application led to the choice of using boron carbide as the filler material making up about 50 percent by volume of the hard layers described in the foregoing example. This combination produces one of the hardest FRCMC materials currently feasible using preferred forming methods. The disclosed selection process also led to the choice of tightly woven Nextel 312 fiber sheets in the ductile layers of the foregoing example. This fiber choice, in conjunction with the use of boron nitride as an interface material, provides one of the most ductile FRCMC materials possible at the present time.

Given that the hardness and ductility are maximized, the stopping ability of the layered FRCMC armor will depend on the number and thickness of the layers employed. Essentially, a hard layer will dissipate more energy as it is increased in thickness because it will take more energy to fracture the material. Similarly, the thicker the ductile layer, the more energy it will take to cause it to yield. Accordingly, more energy is dissipated in the ductile layer as it is increased in thickness. As for the number of layers employed in the armor structure, it is evident that each layer (hard or ductile) will dissipate some amount of the kinetic energy of the projectile. Thus, the more layers there are, the more energy that can be dissipated. The choice of how many layers, and of what thickness, incorporated into the layered FRCMC armor structure will depend on the application and the type of projectile the armor must protect against. For example, if the structure is to be used as body armor to protect a wearer from small arms fire (such as the 7.62 millimeter APM2 class), the armor need only have the number of layers, or layers of appropriate thicknesses, to stop the type of bullets that might be encountered by the wearer. The number and thickness of the layer is preferably minimized so as to minimize the weight of the armor. The foregoing example was designed for this sort of small arms protection. The first hard layer which takes the initial impact of the projectile, was made 0.160 inches thick. The adjacent first ductile layer was made 0.06 inches thick. It required two sheets of the woven Nextel 312 fiber cloth to achieve this thickness. The second hard layer was made to be 0.110 inches thick, and the third hard layer was made to be 0.056 inches thick. The intervening second ductile layer, as well as the final ductile layer, were of the same thickness as the first ductile layer. The reason for progressively reducing the thickness of the hard layers was to reduce the overall weight of the armor structure. As the pieces of the projectile which reach the second and third hard layers have progressively less kinetic energy, the layers did not have to be as thick. The ductile layers were kept at the same thickness because the use of two plies of ceramic fabric is preferred to ensure a ductile failure mode. Reducing this thickness further would require the use of a thinner, less desired, ceramic cloth. The layered FRCMC armor structure of the foregoing example is designed to stop a projectile of up to 170 grains in weight and traveling at velocities up to 2900 feet per second. This is consistent with a 7.62 millimeter AP round.

Up to this point, the hard layer was described only in terms of its hardness, and it ability to shatter the impacting projectile. However, in some circumstances, it might be desirable for a hard layer to exhibit an enhanced ductility, at the expense of some of the hardness. This might be accomplished by, for example, reducing the percentage of filler material and increasing the amount of fibers in the layer. Essentially, the increased ductility would allow the layer to dissipate more of the kinetic energy of the projectile, before fracturing, even though it would not have as much of a propensity to shatter the projectile. This modified hard layer might be useful in a situation where, for practical reasons, the armor must be limited in weight to the point where the number of layers and/or their thickness can not be made sufficient to stop some of the projectiles which the armor must protect against. For example, body armor employed in a military setting may not be able to be made thick enough to stop all possible threats without making it too cumbersome to wear. In such a situation, the innermost hard layer might be increased in ductility as a last defense against the projectile pieces that make it that far. The increased ductility would allow more of the remaining kinetic energy of these pieces to be dissipated prior to the layer fracturing in an attempt to minimize injury to the wearer, even though the pieces would not be broken up as much as would be the case with a harder layer. However, as the preceding hard layers of the armor will have already substantially shattered the projectile, this final breaking up of the projectile pieces may not be as effective in stopping them from passing through the back of the armor, than would increasing the energy dissipating capability of final hard layer by increasing its ductility.

A further aspect of the present invention involves the use of a backing structure for the previously described integrated, layered FRCMC armor. Typically, monolithic ceramic armor is attached, such as by adhesive bonding, to a backing structure for support. Often, these backing structures form part of the article or machine being armored. They are typically made of metal. It would be, of course, possible to attach FRCMC armor embodying the present invention to these same backing structures. This allows FRCMC armor to be employed in existing armored units. In addition, the backing structure would further enhance the overall projectile stopping ability of the armor system. However, the nature of the FRCMC armor and the way it is formed provide an opportunity to greatly simplify the incorporation of a backing structure. Namely, the backing structure could be made from a fiber reinforced organic composite and integrally formed as part of the FRCMC armor.

It is well known to use fiber reinforced organic composites to form structural components. These composites are light weight and strong, and are often used in structures instead of metal. Fiber reinforced polymer composite structures are generally made by combining an organic resin with reinforcing fibers, forming the mixture into the desired shape, and curing the resin. Any number of thermo-setting organic resins are appropriate for these structures, such as resins from the epoxy, polyurethane, acrylic, vinyl-ester, polyimide, poly-ester, poly-vinylester, bismolymides groups. Appropriate fibers include, but are not limited to, carbon, graphite, glass, aramide (KEVLAR[198] ), and ULTRAFIBER™ manufactured by Allied Signal Corporation.

An integrally formed organic composite structure will provide support for the FRCMC armor in place of or in conjunction with more traditional metal backing structures. When the FRCMC armor is combined with the polymer composite backing structure, the thickness required for any metal support structure is further reduced or in some cases the metal structure can be eliminated. For example, the door of a light weight personnel carrier used to transport troops in a relatively safe area may consist of thin aluminum or even canvas stretched over a light metal frame. This door could be replaced by a door formed of an integrally formed FRCMC armor and fiber reinforced organic composite backing structure. The organic composite structure would form the portion of the door which interfaces with the rest of the vehicle, i.e. the hinge, frame, etc. This new door would be stronger than the original, not significantly heavier, and would have the added advantage of providing protection from small arms projectiles. It is also noted that the organic backing structure need not just be formed on the back surface of the layered FRCMC armor. Rather, the organic composite backing structure could be formed so as to encase all or a substantial portion of the external surface of the layered FRCMC armor, if desired.

In another embodiment of layered armor constructed in accordance with the present invention layers of the aforementioned fiber reinforced organic composite materials are integrated within the armor structure. These organic composite layers could replace one or more of the ductile FRCMC layers in the armor structure, or could be integrated between one or more pairs of hard and ductile FRCMC layers within the armor structure. Essentially, the organic composite layers would function in much the same way as the ductile FRCMC layers described previously. However, polymer composites are somewhat lower in cost than FRCMC materials, and can be lighter in some cases. It is also theorized that a layer made of polymer composite materials when used in combination with pairs of hard and ductile FRCMC layers may provide the armor with the capability to stop higher energy projectiles more effectively than a wholly FRCMC layer structure. Thus, whether employed as a replacement for, or a supplement to, the ductile FRCMC layers in the armor, the use of fiber reinforced organic composite layers can be advantageous.

It is envisioned that the FRCMC portions of the armor, whether single hard layers, hard-ductile layer pairs, or a complete layered FRCMC armor structure lacking only the backing structure, would be formed first, as described previously. Thereafter, the FRCMC portions of the armor would be positioned in a mold, such as the type used for the molding of organic composites, and the desired organic resin-fiber mixture added. Essentially, the mold would be designed such that the portion of the mold cavity not taken up by the FRCMC portions of the armor would have the shape of the desired organic layers andlor backing structure. Once the organic resin-fiber mixture is in place, it is formed adjacent to or around the FRCMC portions via any conventional process, such as by compression molding. The organic resin is then cured to form an integrated FRCMC and fiber reinforce organic composite armor structure.

While the invention has been described in detail by reference to the preferred embodiment described above, it is understood that variations and modifications thereof may be made without departing from the true spirit and scope of the invention.

Wherefore, what is claimed is:

1. A method of making integrated, layered fiber reinforced ceramic matrix composite FRCMC armor comprising the steps of:

(a) placing a quantity of FRCMC bulk molding compound into a female die of a mold, said FRCMC bulk molding compound comprising a pre-ceramic resin;

(b) placing at least one sheet of woven fibers on top of said quantity of FRCMC bulk molding compound;

(c) repeating steps (a) and (b) as desired;

(d) pressing a male die of the mold onto the female die so as to mold said armor in a cavity formed between the female and male dies, said cavity having a shape corresponding a desired shape of the armor;

e) heating the mold at a temperature and for a time associated with the pre-ceramic resin which polymerizes the resin to form a fiber-reinforced polymer composite structure;

(f) removing the polymerized composite structure from the mold; and (g) heating the polymerized composite structure at a temperature and for a time associated with the polymerized resin which pyrolizes the polymerized composite structure.

2. The method of claim 1, wherein the step of placing the at least one sheet of woven fibers is preceded by the step of saturating the sheet with said pre-ceramic resin.

3. The method of claim 1, wherein the step of placing the quantity of FRCMC bulk molding compound into the female die of the mold is preceded by placing at least one sheet of woven fibers saturated with said pre-ceramic resin into the female die of the mold, said quantity of FRCMC bulk molding compound being placed on top of the resin saturated sheets of woven fibers.

4. The method of claim 1, further comprising the steps of:

(h) after the completion of step (g), immersing the pyrolized composite structure containing pores formed during step (g), into a bath of a pre-ceramic resin to fill the pores;

(i) heating the pyrolized composite structure at a temperature and for a time associated with the resin filling said pores so as to transform the pyrolized composite structure to a ceramic material;

(j) repeating steps (h) and (i) until the pore density within the pyrolized composite structure is less than a prescribed percentage by volume.

5. The method of claim 1, wherein the FRCMC bulk molding compound further comprises:

fibers; and hardness-producing filler material in sufficient quantity to produce a degree of hardness in the armor so as to make it capable of shattering a projectile impacting thereon and dissipating at least a portion of the kinetic energy associated with the resulting projectile pieces.

6. The method of claim 5, wherein the quantity of FRCMC bulk molding compound forms a hard layer of the armor, and wherein:

the percentage by volume of the hard layer consisting of the fibers is within a range of about 15 to 40 percent;

the percentage by volume of the hard layer consisting of the hardness-producing filler material is within a range of about 25 to 60 percent; and the percentage by volume of the hard layer consisting of the pre-ceramic resin is within a range of about 15 to 40 percent.

7. The method of claim 5, wherein the hardness-producing filler material comprises at least one of alumina, silicon carbide, silicon nitride, tungsten carbide, chrome carbide, chrome oxide, mullite, silica, and boron carbide.

8. The method of claim 5, wherein the at least one sheet of woven fibers forms a part of a ductile layer of the armor, and wherein fibers produce a degree of ductility which causes the ductile layer to yield under the force of impinging pieces of the shattered projectile which pass through an adjacent hard layer thereby dissipating at least a substantial portion of the remaining kinetic energy of said pieces.

9. The method of claim 8, wherein the percentage by volume of the ductile layer consisting of fibers is within a range of about 30 to 50 percent.

10. The method of claim 8, wherein the woven fibers are coated with an interface material comprising comprises at least one 0.1–0.5 micron thick layer of at least one of carbon, silicon nitride, silicon carbide, and boron nitride.

11. The method of claim 8, wherein the fibers comprise at least one of alumina, silicon nitride, silicon carbide, graphite, carbon, and peat.

12. The method of claim 1, wherein the desired shape of the armor is such that it substantially conforms to the shape of an object to be protected by the armor.

* * * * *